US011126112B2

(12) United States Patent
Carpenter et al.

(10) Patent No.: US 11,126,112 B2
(45) Date of Patent: Sep. 21, 2021

(54) TONER AGITATOR SUPPORT

(71) Applicant: LEXMARK INTERNATIONAL, INC., Lexington, KY (US)

(72) Inventors: Brian Scott Carpenter, Lexington, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/082,731

(22) Filed: Oct. 28, 2020

(65) Prior Publication Data

US 2021/0200115 A1 Jul. 1, 2021

Related U.S. Application Data

(60) Provisional application No. 62/954,093, filed on Dec. 27, 2019, provisional application No. 63/020,389, filed on May 5, 2020.

(51) Int. Cl.
*G03G 15/08* (2006.01)

(52) U.S. Cl.
CPC ..... *G03G 15/0889* (2013.01); *G03G 15/087* (2013.01); *G03G 15/0812* (2013.01); *G03G 15/0881* (2013.01); *G03G 2215/0663* (2013.01); *G03G 2215/085* (2013.01)

(58) Field of Classification Search
CPC ..... G03G 15/0889; G03G 15/0891; G03G 15/081; G03G 2215/085; G03G 2215/0811; G03G 2215/0838; G03G 2215/0813
USPC ..... 399/254, 256
See application file for complete search history.

(56) References Cited

U.S. PATENT DOCUMENTS

| | | | |
|---|---|---|---|
| 5,875,378 | A | 2/1999 | Campbell et al. |
| 5,884,130 | A | 3/1999 | Tsutsumi et al. |
| 6,459,876 | B1 | 10/2002 | Buchanan et al. |
| 6,771,922 | B2 | 8/2004 | Blanck et al. |
| 7,433,632 | B2 | 10/2008 | Askren et al. |

(Continued)

FOREIGN PATENT DOCUMENTS

| | | | |
|---|---|---|---|
| EP | 3327512 | A1 | 5/2018 |
| JP | 11174842 | A * | 7/1999 |

(Continued)

OTHER PUBLICATIONS

EPO machine translation of WO 2016143211 A1 (Yoshii et al.).

*Primary Examiner* — Robert B Beatty
(74) *Attorney, Agent, or Firm* — Justin M. Tromp

(57) ABSTRACT

A toner container according to one example embodiment includes a housing having a reservoir for storing toner. A rotatable developer roll is mounted on the housing. A doctor blade has a distal end in contact with the outer surface of the developer roll along a length of the developer roll for metering toner on the outer surface of the developer roll. The doctor blade has a proximate end positioned against a portion of the housing. A toner agitator in the reservoir has a shaft. A support in the reservoir is positioned in close proximity to the shaft to limit bending of the shaft. A first end of the support contacts an inner surface of the portion of the housing that the proximate end of the doctor blade is positioned against. The support stiffens the portion of the housing that the proximate end of the doctor blade is positioned against.

19 Claims, 8 Drawing Sheets

(56) References Cited

U.S. PATENT DOCUMENTS

| | | | | |
|---|---|---|---|---|
| 7,532,843 | B2 | 5/2009 | Kern et al. | |
| 8,463,163 | B2 * | 6/2013 | Goto | G03G 15/081 399/254 |
| 8,660,469 | B2 | 2/2014 | Carter, II et al. | |
| 8,755,713 | B2 | 6/2014 | Poterjoy et al. | |
| 8,918,032 | B2 | 12/2014 | Abler et al. | |
| 8,989,632 | B2 | 3/2015 | Leemhuis et al. | |
| 9,354,544 | B2 * | 5/2016 | Sato | G03G 15/0812 |
| 9,360,796 | B2 | 6/2016 | Leemhuis | |
| 9,703,234 | B1 | 7/2017 | Bejat et al. | |
| 9,869,950 | B1 | 1/2018 | Leemhuis | |
| 9,904,212 | B2 | 2/2018 | Meneses | |
| 10,139,750 | B2 * | 11/2018 | Jang | G03G 15/087 |
| 10,203,628 | B1 | 2/2019 | Williamson | |
| 2008/0226351 | A1 | 9/2008 | Dawson et al. | |
| 2013/0136465 | A1 * | 5/2013 | Yoshida | G03G 15/0858 399/27 |
| 2013/0170875 | A1 | 7/2013 | Sproul et al. | |
| 2013/0279941 | A1 * | 10/2013 | Poterjoy | G03G 15/0889 399/254 |

FOREIGN PATENT DOCUMENTS

| | | | | |
|---|---|---|---|---|
| JP | 2007010817 | A | * | 1/2007 |
| WO | 2016143211 | A1 | | 9/2016 |

* cited by examiner

TONER AGITATOR SUPPORT

CROSS REFERENCES TO RELATED APPLICATIONS

This application claims priority to U.S. Provisional Patent Application Ser. No. 62/954,093, filed Dec. 27, 2019, entitled "Toner Agitator Support," and to U.S. Provisional Patent Application Ser. No. 63/020,389, filed May 5, 2020, entitled "Toner Agitator Support," the contents of which are hereby incorporated by reference in their entirety.

BACKGROUND

1. Field of the Disclosure

The present disclosure relates generally to image forming devices and more particularly to a toner agitator support.

2. Description of the Related Art

In electrophotographic image forming devices, one or more toner cartridges may be used to supply toner for printing onto sheets of media. Toner cartridges often include one or more toner agitators positioned within a toner reservoir of the toner cartridge that agitate and mix the toner and that move the toner in a direction to exit the toner from the toner cartridge. Many toner agitators include a rotatable shaft having one or more extensions or projections outward therefrom that mix and move toner as the shaft rotates. It has been observed that vibrating a toner cartridge (such as may occur during shipment of the toner cartridge) tends to pack the toner stored in the reservoir, which increases the torque required to rotate the shaft. Long periods of inactivity (such as during storage of the toner cartridge prior to shipment or prior to first use of the toner cartridge) may also tend to pack the toner stored in the reservoir.

Rotation of the toner agitator shaft under high torque loads, such as due to packed toner, may tend to bend or break the shaft. Toner agitator shafts may also be susceptible to bending or breaking from impact loads that occur if the toner cartridge is accidentally dropped. One solution to reduce damage is to construct the toner agitator shaft from higher strength materials. However, this approach typically increases the cost of the toner agitator shaft.

Accordingly, a cost-effective toner agitator having improved resistance to damage is desired.

SUMMARY

A toner container for use in an electrophotographic image forming device according to one example embodiment includes a housing having a reservoir for storing toner. A rotatable developer roll is mounted on the housing for transferring toner from an outer surface of the developer roll to a corresponding photoconductive drum during operation of the toner container in the image forming device. A doctor blade has a distal end in contact with the outer surface of the developer roll along a length of the developer roll for metering toner on the outer surface of the developer roll. The doctor blade has a proximate end positioned against a portion of the housing. A toner agitator in the reservoir has a shaft. A support in the reservoir is positioned in close proximity to the shaft to limit bending of the shaft. A first end of the support contacts an inner surface of the portion of the housing that the proximate end of the doctor blade is positioned against. The support stiffens the portion of the housing that the proximate end of the doctor blade is positioned against.

A toner container for use in an electrophotographic image forming device according to another example embodiment includes a housing having a reservoir for storing toner. A rotatable developer roll is mounted on the housing for transferring toner from an outer surface of the developer roll to a corresponding photoconductive drum during operation of the toner container in the image forming device. A doctor blade has a distal end in contact with the outer surface of the developer roll along a length of the developer roll for metering toner on the outer surface of the developer roll. The doctor blade has a proximate end positioned against a portion of the housing. A toner agitator in the reservoir has a shaft. A support in the reservoir is positioned in close proximity to the shaft to limit bending of the shaft. A first end of the support contacts an inner surface of the portion of the housing that the proximate end of the doctor blade is positioned against. The support is formed integrally with the portion of the housing that the proximate end of the doctor blade is positioned against.

A toner container for use in an electrophotographic image forming device according to another example embodiment includes a housing having a reservoir for storing toner. A rotatable developer roll is mounted on the housing for transferring toner from an outer surface of the developer roll to a corresponding photoconductive drum during operation of the toner container in the image forming device. A rotatable toner adder roll is mounted on the housing and is positioned to supply toner in the reservoir to the developer roll. A rotatable toner agitator in the reservoir has a shaft. The toner agitator is positioned to mix toner near the toner adder roll. A support in the reservoir is positioned in close proximity to the shaft to limit bending of the shaft. The support contacts an inner surface of the housing that defines a volume of the reservoir. The support is formed integrally with a portion of the housing.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
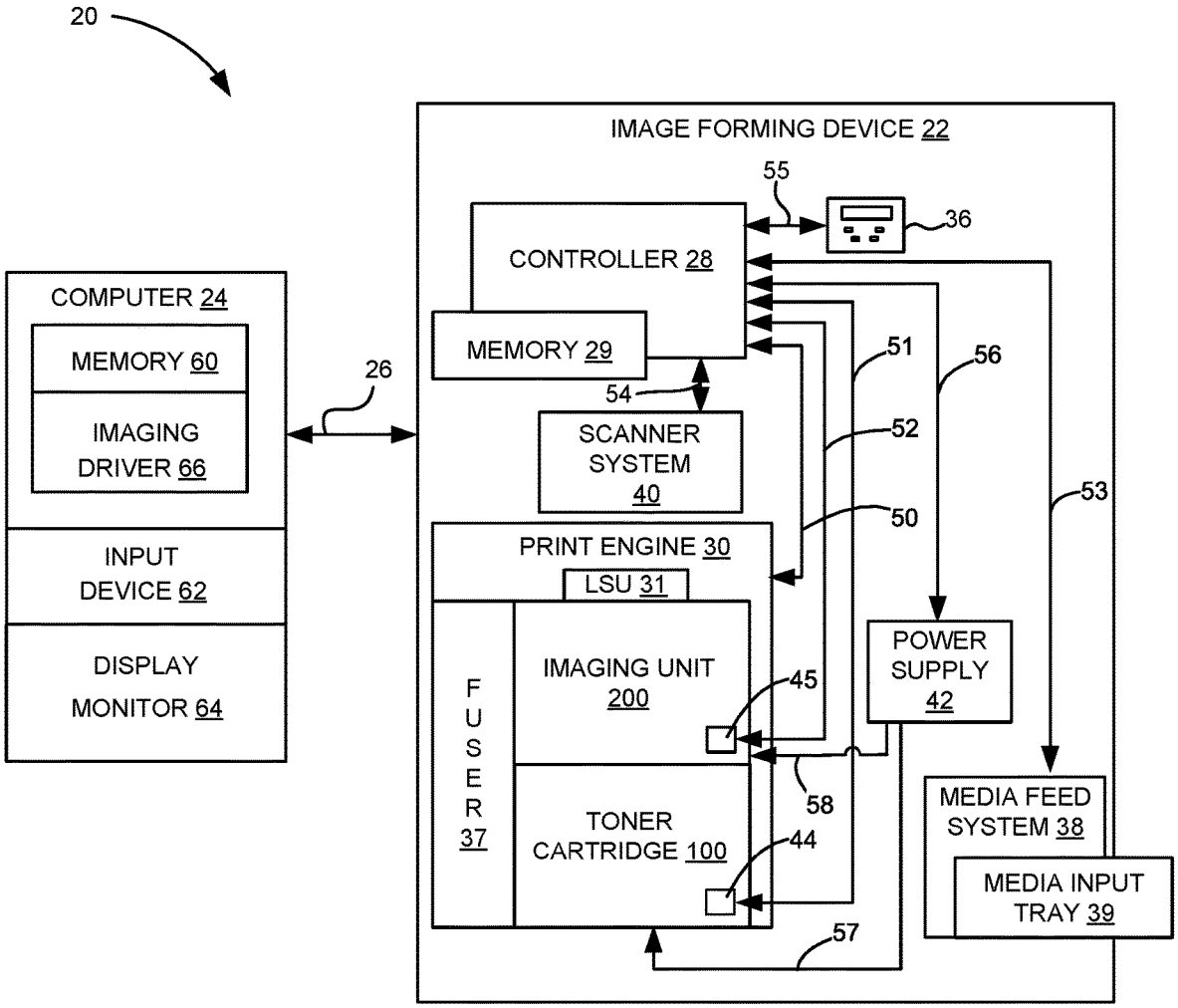
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, an imaging unit 200, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with power supply 42 via a communications link 56. Controller 28 processes print and scan data and operates print engine 30 during printing and scanner system 40 during scanning. Processing circuitry 44, 45 may provide authentication functions, safety and operational interlocks, operating parameters and usage information related to toner cartridge 100 and imaging unit 200, respectively. Each of processing circuitry 44, 45 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile and/or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Toner cartridge 100 and imaging unit 200 are removably mounted in image forming device 22. Power supply 42 provides an electrical voltage to various components of toner cartridge 100 and imaging unit 200 via respective electrical paths 57 and 58. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and one imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200. Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
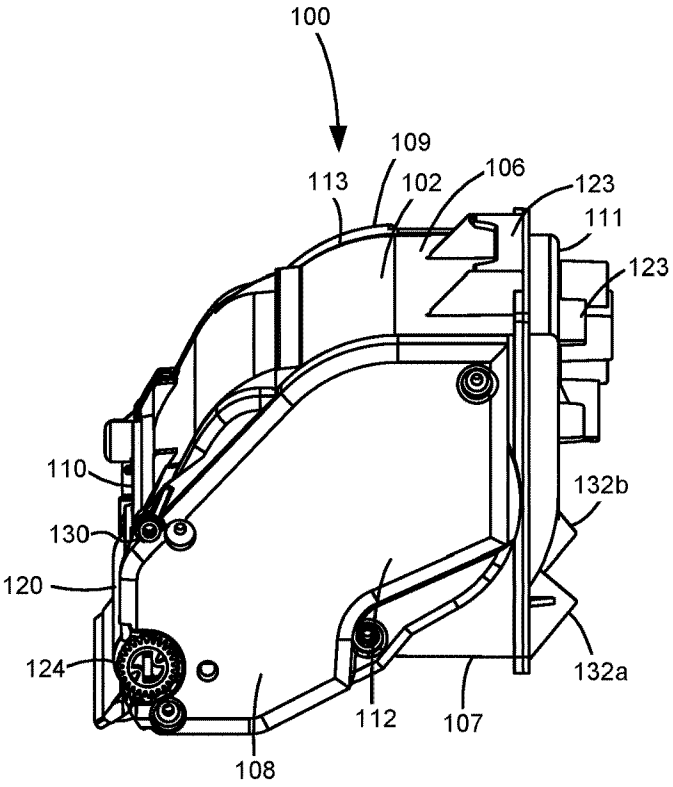
FIG. 2 is a perspective view of a toner cartridge and an imaging unit separated from each other according to one example embodiment.
Figure 2:
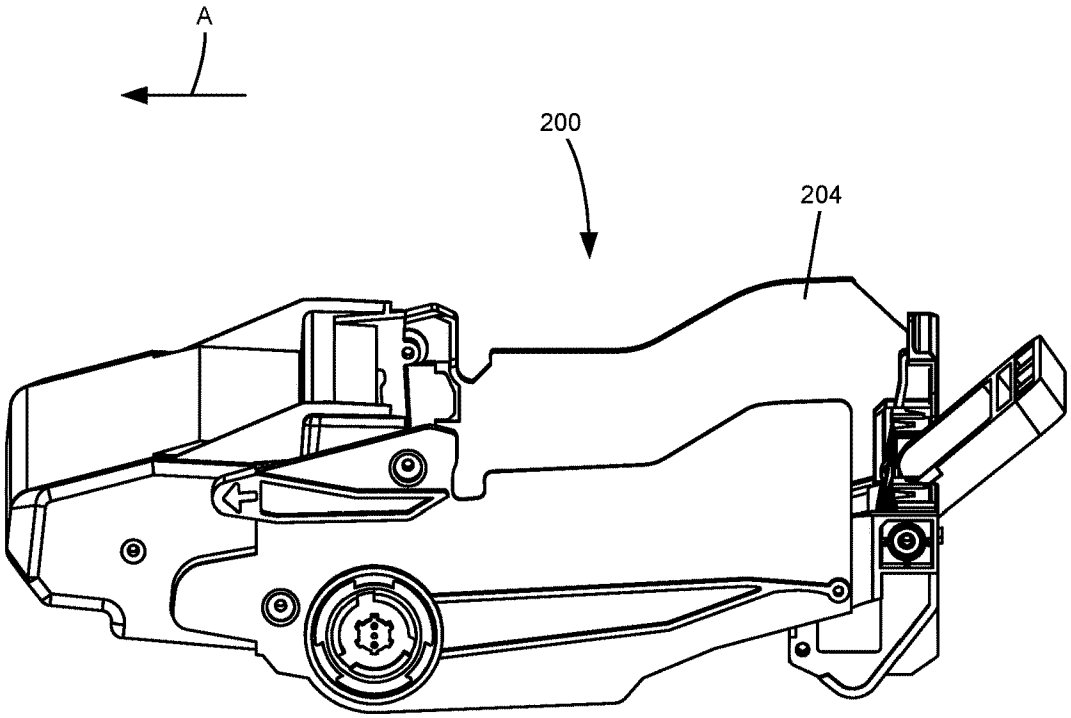
Figure 3:
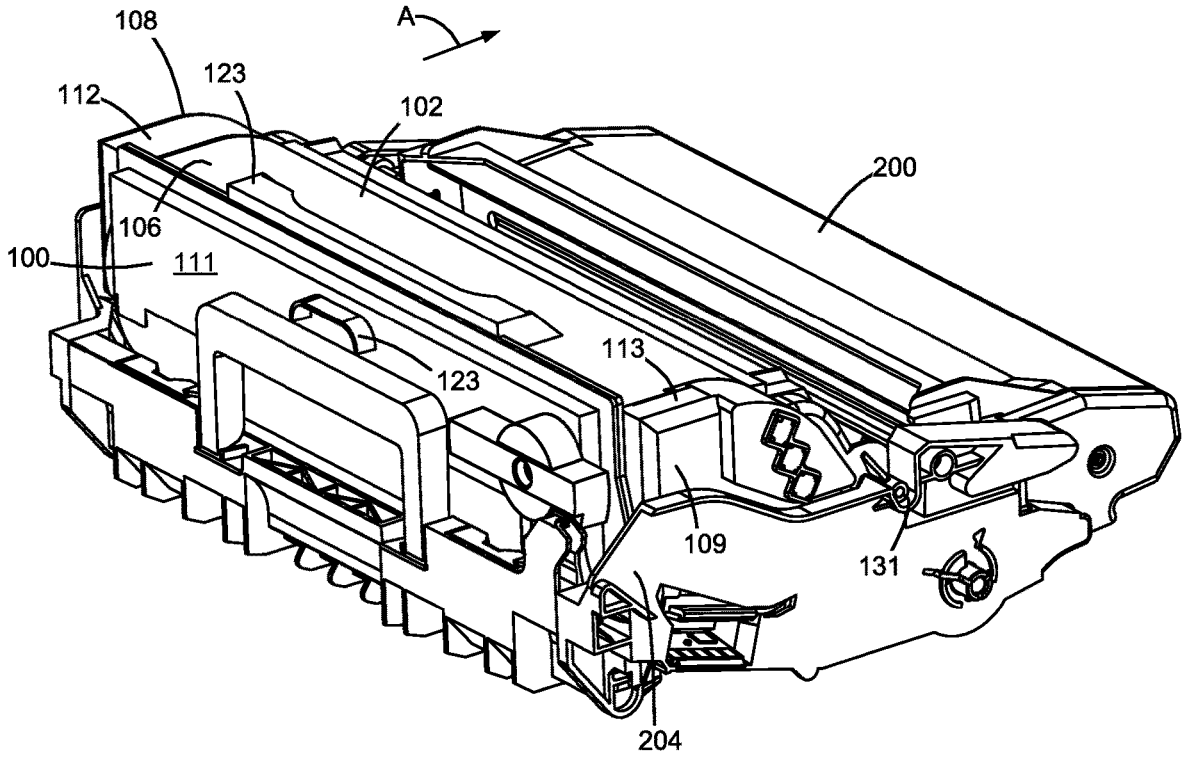
FIG. 3 is a perspective view of the toner cartridge and the imaging unit shown in FIG. 2 mated with each other according to one example embodiment.
Figure 4:
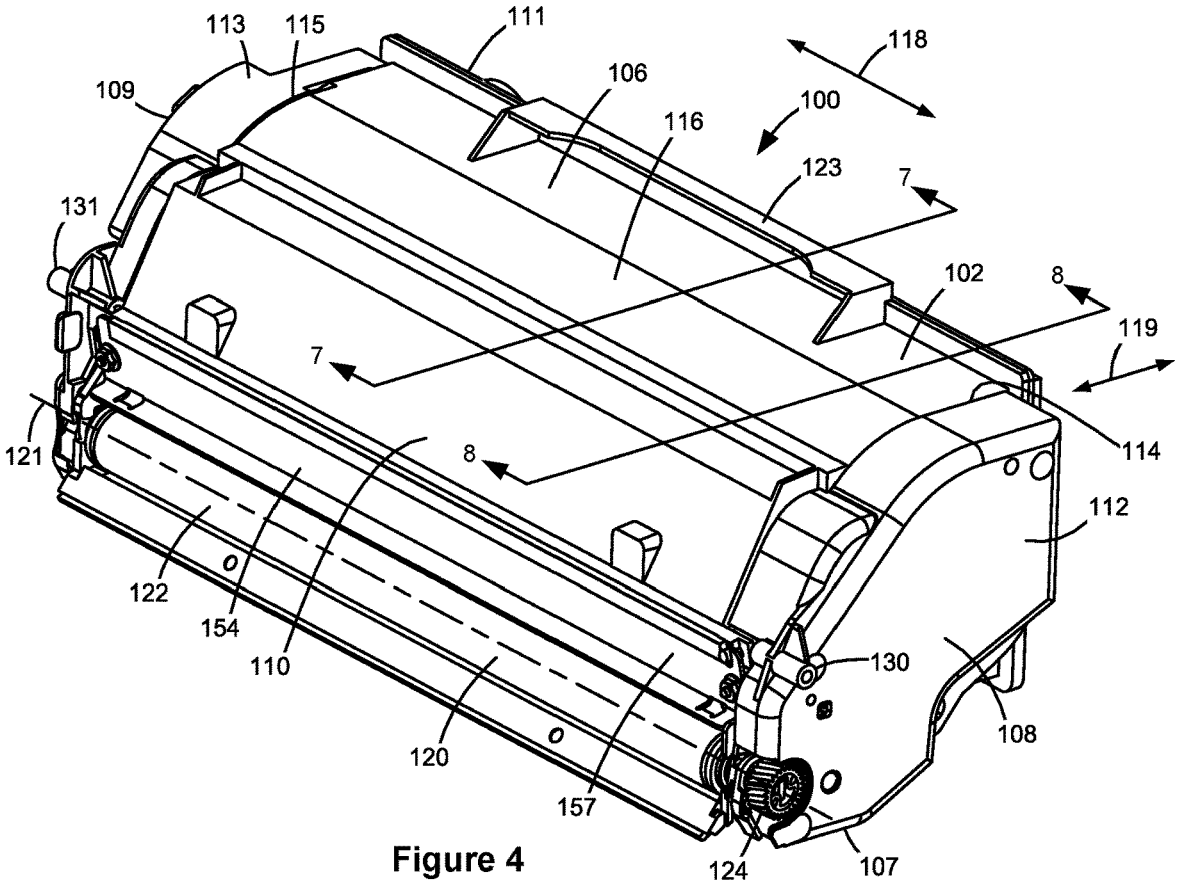
FIG. 4 is a front perspective view of the toner cartridge shown in FIGS. 2 and 3.
Figure 5:
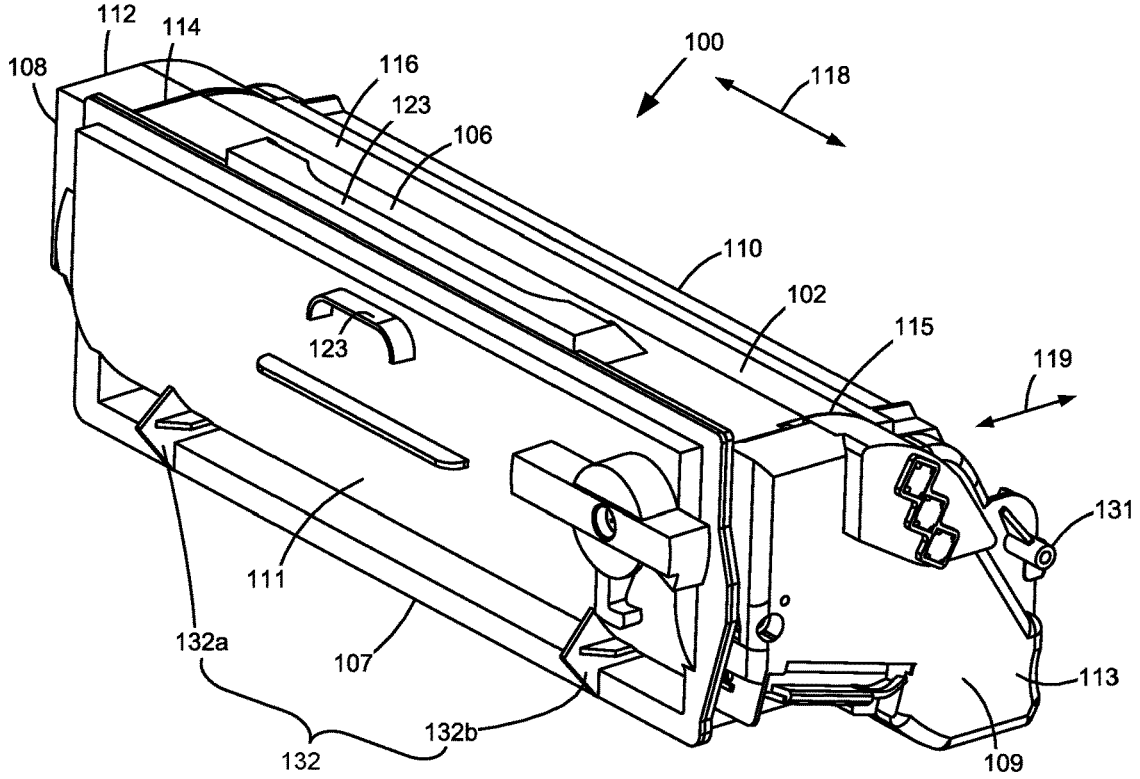
FIG. 5 is a rear perspective view of the toner cartridge shown in FIGS. 2-4.

Referring now to FIGS. 2 and 3, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200. Toner cartridge 100 and imaging unit 200 are then slidably inserted together into image forming device 22. FIG. 2 shows toner cartridge 100 and imaging unit 200 separated from each other, and FIG. 3 shows toner cartridge 100 installed on imaging unit 200. The arrow A shown in FIGS. 2 and 3 indicates the direction of insertion of toner cartridge 100 and imaging unit 200 into image forming device 22. This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

With reference to FIGS. 2-5, toner cartridge 100 includes a housing 102 having an enclosed reservoir 104 (FIG. 6) for storing toner. Housing 102 includes a top 106, a bottom 107, first and second sides 108, 109, a front 110 and a rear 111. Front 110 of housing 102 leads during insertion of toner cartridge 100 into image forming device 22, and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109. A portion of an outer surface 122 of developer roll 120 is exposed from housing 102 along front 110 of housing 102, near bottom 107 of housing 102 for delivering toner from toner cartridge 100 to a corresponding photoconductive drum of imaging unit 200. In this manner, developer roll 120 forms an outlet for exiting toner from toner cartridge 100.

A handle 123 may be provided on top 106 and/or rear 111 of housing 102 to assist with coupling and decoupling toner cartridge 100 to and from imaging unit 200 and insertion and removal of toner cartridge 100 and imaging unit 200 into and out of image forming device 22.

Toner cartridge 100 also includes an interface gear 124 positioned, for example, on side 108 of housing 102. In the embodiment illustrated, interface gear 124 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, interface gear 124 is mounted to a shaft of developer roll 120, coaxial with developer roll 120. In this embodiment, a front portion of interface gear 124 is exposed on the front 110 of housing 102, near bottom 107 of housing 102 and is unobstructed to mate with and receive rotational force from the corresponding drive gear on imaging unit 200. In the embodiment illustrated, interface gear 124 is rotatably connected to a drive train that is positioned between end cap 112 and side wall 114 of housing 102. The drive train aids in transferring rotational force from interface gear 124 to rotatable components of toner cartridge 100, including, for example, to a toner adder roll that supplies toner from reservoir 104 to developer roll 120 and to one or more toner agitators that move toner in reservoir 104 toward the toner adder roll and that agitate and mix the toner in reservoir 104. In the example embodiment illustrated, interface gear 124 is formed as a helical gear, but other configurations may be used as desired.

Toner cartridge 100 also includes an alignment guide 130, 131 extending outward from each side 108, 109 of housing 102. Alignment guides 130, 131 assist with mating toner cartridge 100 to imaging unit 200 and with positioning toner cartridge 100 relative to imaging unit 200 during operation in image forming device 22. Alignment guides 130, 131 are received by corresponding guides on imaging unit 200 that aid in positioning toner cartridge 100 relative to imaging unit 200. Alignment guides 130, 131 are spaced above developer roll 120 along front 110 of housing 102, e.g., at the same height as each other and at the same position along a front-to-rear dimension 119 of housing 102.

Toner cartridge 100 also includes one or more engagement members 132 that receive a bias force from corresponding hold-downs on imaging unit 200 to retain toner cartridge 100 in its operative position on imaging unit 200 during operation. For example, the bias force received by engagement members 132 maintains contact between developer roll 120 and the corresponding photoconductive drum on imaging unit 200 and between interface gear 124 and the corresponding drive gear on imaging unit 200.

Figure 6:
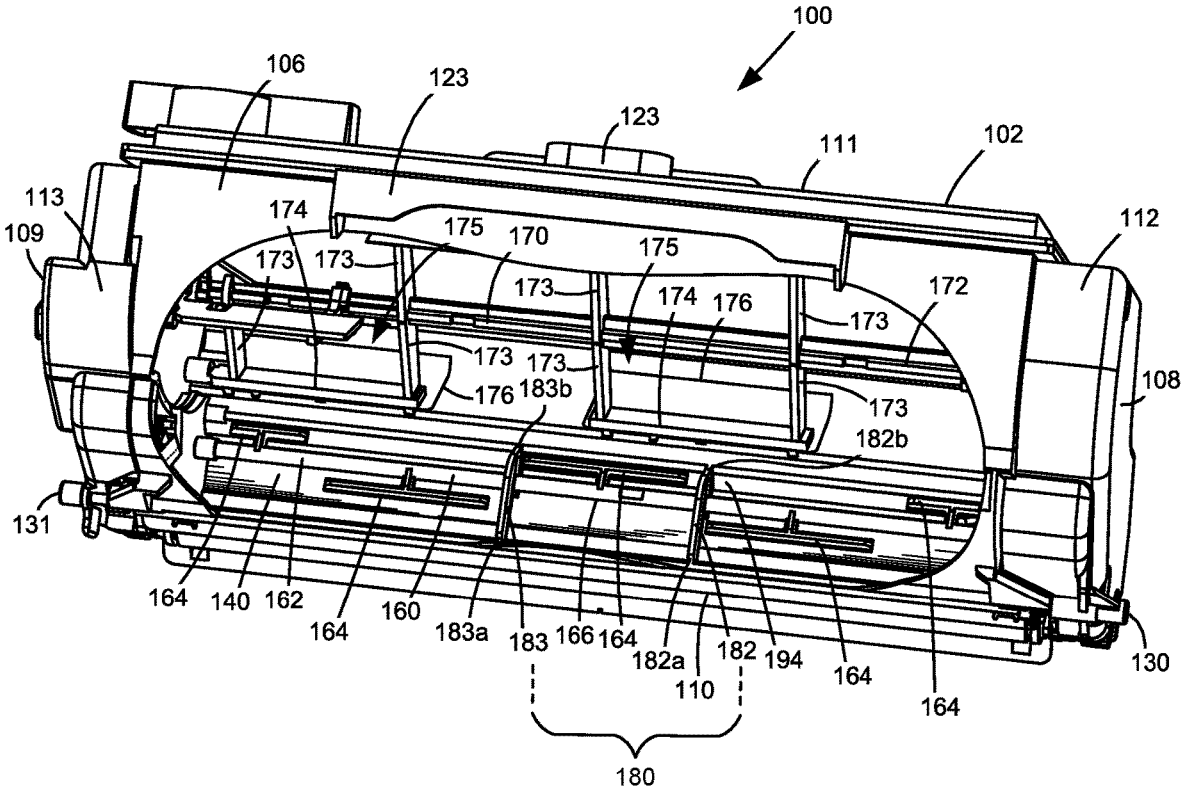
FIG. 6 is a perspective view of the toner cartridge shown in FIGS. 2-5 with a portion of a top of the toner cartridge cutaway to show internal components of the toner cartridge according to one example embodiment.
Figure 7:
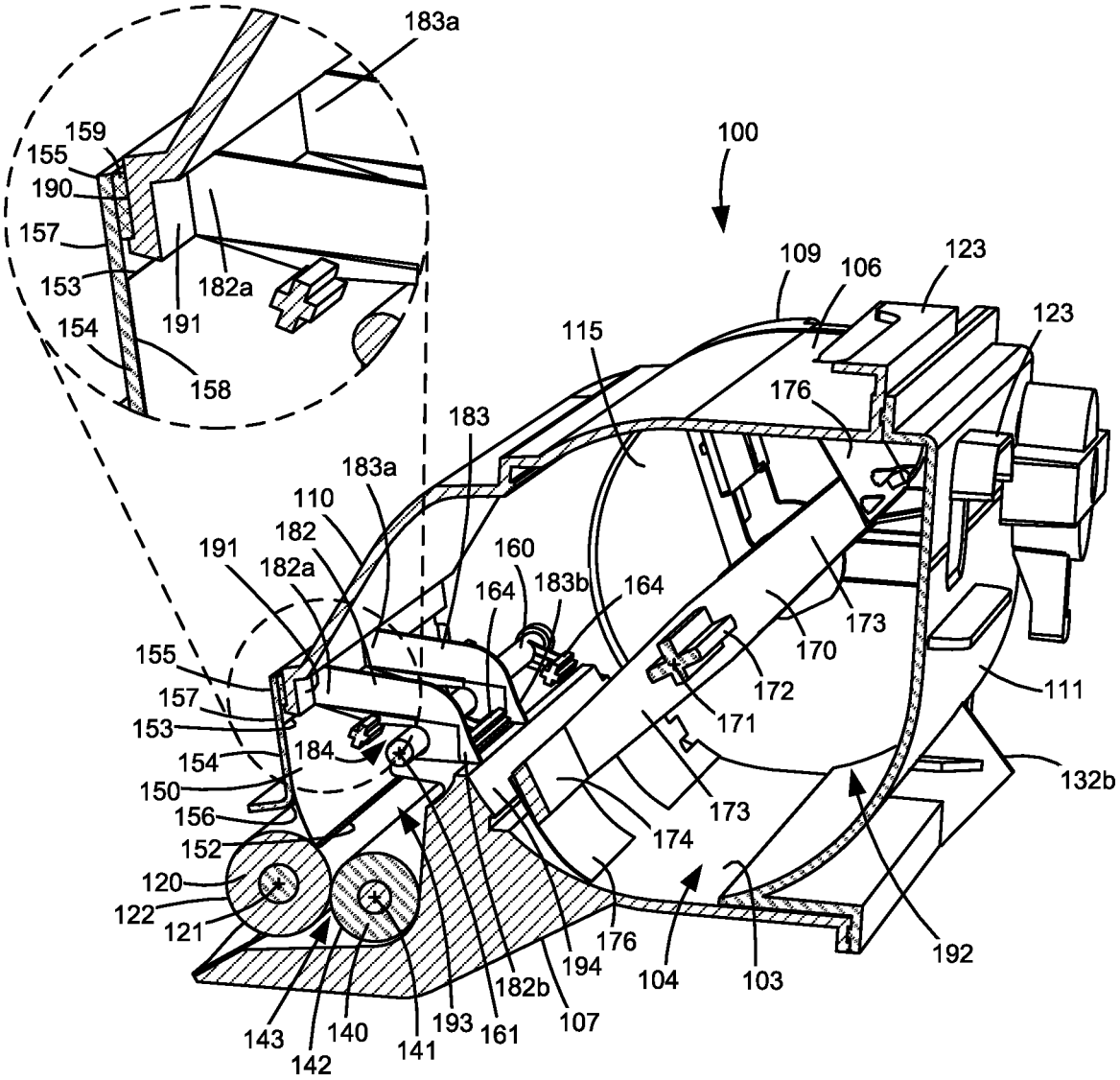
FIG. 7 is a cross-sectional view of the toner cartridge taken along line 7-7 in FIG. 4.
Figure 8:
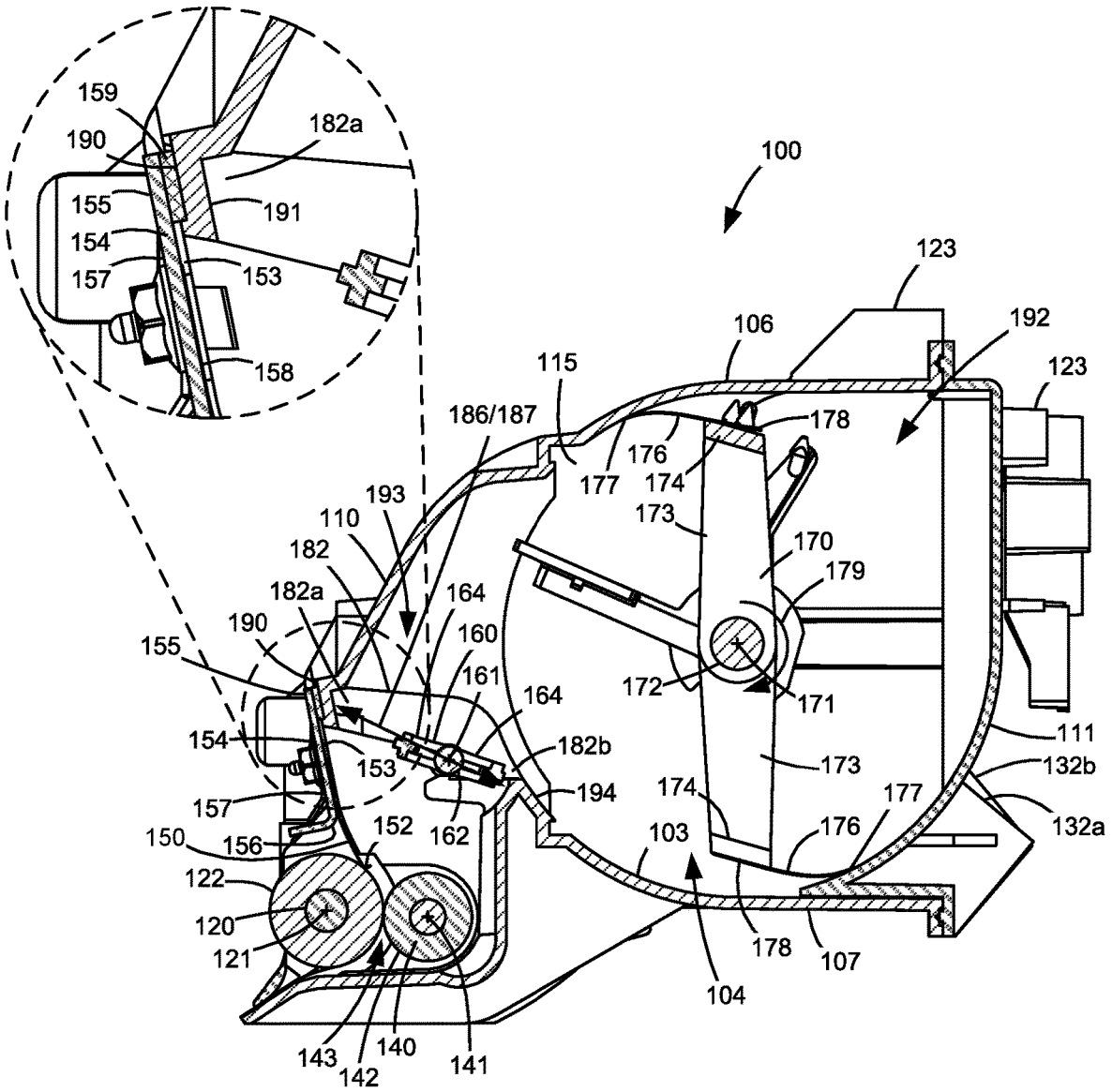
FIG. 8 is a cross-sectional view of the toner cartridge taken along line 8-8 in FIG. 4.

FIG. 6 shows toner cartridge 100 with a portion of top 106 of housing 102 cut away. FIGS. 7 and 8 are cross-sectional views of toner cartridge 100 taken along line 7-7 and line 8-8, respectively, in FIG. 4. FIGS. 6-8 illustrate internal components of toner cartridge 100 according to one example embodiment. In the embodiment illustrated, toner cartridge 100 includes a rotatable toner adder roll 140 positioned to supply toner in reservoir 104 to developer roll 120. Toner adder roll 140 includes a rotational axis 141 that is parallel to rotational axis 121 of developer roll 120. A portion of an outer surface 142 of toner adder roll 140 is in contact with a portion of outer surface 122 of developer roll 120 along the lengths of toner adder roll 140 and developer roll 120 forming a nip 143 that facilitates the transfer of toner from outer surface 142 of toner adder roll 140 to outer surface 122 of developer roll 120 during operation.

Toner cartridge 100 also includes a doctor blade 150. A distal end 152 of doctor blade 150 contacts outer surface 122 of developer roll 120 along the length of developer roll 120 in order to regulate the amount of toner on outer surface 122 of developer roll 120. In this manner, doctor blade 150 provides a metered, uniform layer of toner on outer surface 122 of developer roll 120 for transfer to the corresponding photoconductive drum of imaging unit 200. A proximate end 153 of doctor blade 150 is mounted on an outer surface 190 of front 110 of housing 102. In the embodiment illustrated, a bracket 154 attached to front 110 of housing 102 retains proximate end 153 of doctor blade 150 against outer surface 190 of front 110 of housing 102. Proximate end 153 of doctor blade 150 is sandwiched between a top portion 155 of bracket 154 and outer surface 190 of front 110 of housing 102 in order to position doctor blade 150 relative to housing 102. Proximate end 153 of doctor blade 150 may contact outer surface 190 of front 110 of housing 102 directly, or a seal 159 may be positioned between proximate end 153 of doctor blade 150 and outer surface 190 of front 110 of housing 102 in order to help prevent toner leakage from reservoir 104. Bracket 154 extends downward from housing 102 toward developer roll 120 such that an outer side 157 of bracket 154 is exposed on the exterior of toner cartridge 100 immediately above developer roll 120. Doctor blade 150 is positioned against an inner side 158 of bracket 154, and distal end 152 of doctor blade 150 extends in a cantilevered manner from a bottom portion 156 of bracket 154 toward developer roll 120.

In the embodiment illustrated, toner cartridge 100 includes a pair of rotatable toner agitators 160, 170 positioned within toner reservoir 104. Each toner agitator 160, 170 includes a respective rotational axis 161, 171. In the embodiment illustrated, rotational axes 161, 171 are parallel to rotational axis 121 of developer roll 120 and rotational axis 141 of toner adder roll 140. Toner agitator 160 is positioned near front 110 of housing 102 and is spaced above toner adder roll 140. Toner agitator 160 is positioned to agitate and mix toner in reservoir 104 near (e.g., immediately above) toner adder roll 140 to prevent toner from clumping or bridging above toner adder roll 140, which could disrupt the flow of toner to toner adder roll 140 and prevent toner adder roll 140 from supplying toner along the entire length of developer roll 120, potentially causing print defects. In the embodiment illustrated, toner agitator 160 includes a rotatable shaft 162 that defines rotational axis 161 and a series of T-shaped projections 164 extending radially outward from shaft 162. T-shaped projections 164 are spaced axially from each other along the length of shaft 162. In the embodiment illustrated, T-shaped projections 164 are arranged in an alternating pattern such that adjacent projections 164 extend from shaft 162 in opposite radial directions.

Toner agitator 170 is positioned in a central portion of reservoir 104. Toner agitator 170 is positioned to agitate and mix toner in reservoir 104 and to move toner in reservoir 104 toward toner adder roll 140. In the embodiment illustrated, toner agitator 170 includes a rotatable shaft 172 that defines rotational axis 171 and a series of arms 173 that extend radially outward from shaft 172. Toner agitator 170 also includes cross beams 174 that are connected to distal ends of adjacent arms 173. A gap 175 is formed between each cross beam 174 and shaft 172 to allow toner in reservoir 104 to freely move near a central portion of reservoir 104 along the length of shaft 172. In the embodiment illustrated, a wiper 176 is mounted to each cross beam 174 and extends in a cantilevered manner away from cross beam 174 toward an interior surface 103 of housing 102 forming reservoir 104. Wipers 176 are formed from a flexible material such as a polyethylene terephthalate (PET) material, e.g., MYLAR® available from DuPont Teijin Films, Chester, Va., USA. Each wiper 176 includes a distal end 177 and a proximate end 178. Distal end 177 is positioned farthest from cross beam 174, nearest to the interior surface 103 of housing 102. Proximate end 178 is positioned on cross beam 174. In one embodiment, wipers 176 form an interference fit with the interior surfaces 103 of top 106, bottom 107 and rear 111 of housing 102 in order to wipe toner from the interior surfaces 103 of top 106, bottom 107 and rear 111 of housing 102 as shaft 172 rotates. Wipers 176 extend from cross beams 174 in a direction opposite an operative rotational direction 179 of toner agitator 170 so that wipers 176 sweep toner from interior surface 103 of bottom 107 of housing 102 toward toner adder roll 140.

While the example embodiment illustrated includes a toner agitator 160 having a shaft 162 and a series of T-shaped projections 164 from shaft 162, it will be appreciated that toner agitator 160 may include a shaft having projections or extensions of any suitable form and pattern for mixing toner in the area of toner adder roll 140 as desired. Similarly, while the example embodiment illustrated includes a toner agitator 170 having a shaft 172, a series of arms 173 extending from the shaft 172, and wipers 176 positioned at distal ends of the arms 173, it will be appreciated that toner agitator 170 may include a shaft having projections or extensions of any suitable form and pattern for mixing toner in reservoir 104 and moving toner as desired. Further, while the example embodiment illustrated includes a pair of toner agitators 160, 170, more or fewer toner agitators may be used as desired to mix and move toner within reservoir 104.

While the example embodiment illustrated includes rotatable toner agitators 160 and 170, toner agitators 160 and 170 may be movable in any manner desired. For example, while the example embodiment illustrated includes toner agitators 160 and 170 that are rotatable in complete (360 degree) revolutions around respective rotational axes 161 and 171, in other embodiments, toner agitator 160 and/or toner agitator 170 may be rotatable to a limited degree such that toner agitator 160 and/or toner agitator 170 rotates back and forth about its respective rotational axis 161, 171 along a rotational path that is less than 360 degrees. Further, in other embodiments, toner agitator 160 and/or toner agitator 170 may be translatable, for example, along the length of its respective shaft 162, 172.

In the example embodiment illustrated, toner reservoir 104 includes a rear reservoir portion 192 and a front reservoir portion 193. Rear and front reservoir portions 192, 193 are open to each other permitting the free flow of toner between them. In the embodiment illustrated, rear reservoir portion 192 has a larger volume than front reservoir portion 193. Accordingly, rear reservoir portion 192 has a larger toner capacity than front reservoir portion 193 and forms the primary storage area for toner within reservoir 104. Toner adder roll 140 is positioned in front reservoir portion 193 permitting toner adder roll 140 to supply toner from front reservoir portion 193 to developer roll 120. In the embodiment illustrated, toner agitator 160 is positioned in front reservoir portion 193, and toner agitator 170 is positioned in rear reservoir portion 192. Toner agitator 170 is configured to mix the toner in rear reservoir portion 192 and to move toner from rear reservoir portion 192 to front reservoir portion 193 to ensure that toner remains available in front reservoir portion 193 for toner adder roll 140 to supply to developer roll 120. Toner agitator 160 is positioned to mix toner in front reservoir portion 193 to prevent toner from clumping or bridging above toner adder roll 140 in order to ensure that toner adder roll 140 is able to supply toner from front reservoir portion 193 to developer roll 120.

In the example embodiment illustrated, a wall 194 partially segregates rear reservoir portion 192 from front reservoir portion 193. In the embodiment illustrated, wall 194 extends upward from a bottom portion of reservoir 104 and separates a lower portion of rear reservoir portion 192 from a lower portion of front reservoir portion 193. In this embodiment, wall 194 extends higher than bottommost surfaces of rear reservoir portion 192 and front reservoir portion 193. During operation of toner cartridge 100, when toner agitator 170 rotates in operative rotational direction 179, wipers 176 push toner near the interior surface 103 of bottom 107 of housing 102 up and over wall 194 and into front reservoir portion 193. In the embodiment illustrated, front reservoir portion 193 extends lower than rear reservoir portion 192 such that toner pushed over or past wall 194 by toner agitator 170 is allowed to travel downward by way of gravity toward toner adder roll 140. As discussed above, rotation of toner agitator 160 mixes toner in front reservoir portion 193 to ensure a consistent supply of toner to toner adder roll 140.

Toner cartridge 100 includes one or more supports 180 positioned in reservoir 104. The example embodiment illustrated includes a pair of supports 182, 183 that are positioned in close proximity, e.g., immediately adjacent to, shaft 162 of toner agitator 160. Supports 182, 183 partially encircle (e.g., more than 180 degrees around shaft 162) or surround shaft 162 of toner agitator 160 between adjacent projections 164 from shaft 162. For example, in the embodiment illustrated, supports 182, 183 wrap over, under and around a rear side of shaft 162. In the embodiment illustrated, each support 182, 183 includes an opening 184 at a front side of shaft 162 in order to permit installation of toner agitator 160 onto housing 102 through front 110 of housing 102 during assembly of toner cartridge 100 (e.g., prior to installation of toner adder roll 140, developer roll 120, doctor blade 150 and bracket 154 onto housing 102 in the embodiment illustrated).

Supports 182, 183 are positioned to limit bending of shaft 162 in order to prevent shaft 162 from breaking or dislocating. For example, shaft 162 may tend to bend due to high torque loads if toner agitator 160 is rotated while toner in reservoir 104 is compacted, e.g., after shipping or prolonged storage of toner cartridge 100. Shaft 162 may also tend to bend due to impact loads occurring if toner cartridge 100 is accidentally dropped. Supports 182, 183 are spaced from shaft 162 during normal operation of toner agitator 160 so as not to interfere with the rotation of shaft 162, but are positioned to contact shaft 162 upon bending of shaft 162, e.g., due to torque loads, impact loads, or other forces, in order to limit the extent of bending of shaft 162 to prevent breakage or dislocation of shaft 162. In the embodiment illustrated, toner agitator 160, including shaft 162, is composed of a plastic material, e.g., glass-filled polycarbonate. The vulnerability of shaft 162 to bending or breakage could also be reduced by forming shaft 162 from a higher strength material, e.g., steel. However, plastic construction is preferable to metal from a cost perspective. In the embodiment illustrated, supports 182, 183 are positioned in close proximity to a central portion of shaft 162, near a midpoint 166 along the length of shaft 162, where shaft 162 is most susceptible to bending. For example, in the embodiment illustrated, supports 182, 183 are positioned closer to midpoint 166 of shaft 162 than to the ends of shaft 162, which are received by side walls 114, 115.

In the embodiment illustrated, a first end 182*a*, 183*a* of each support 182, 183 contacts an inner surface 191 of front 110 of housing 102 that is opposite the outer surface 190 of front 110 of housing 102 that proximate end 153 of doctor blade 150 is mounted against by bracket 154. In the embodiment illustrated, supports 182, 183 help stiffen the portion of front 110 of housing 102 that doctor blade 150 is mounted against. The additional rigidity provided by supports 182, 183 to front 110 of housing 102 helps maintain proper positioning of doctor blade 150 relative to developer roll 120 and helps ensure that doctor blade 150 remains sealed against outer surface 190 of front 110 of housing 102 in order to prevent toner leakage from reservoir 104. A second end 182*b*, 183*b* of each support 182, 183 contacts wall 194 that partially segregates rear reservoir portion 192 from front reservoir portion 193. In the embodiment illustrated, a longitudinal dimension 186, 187 of each support 182, 183 extending from its respective first end 182*a*, 183*a* to its respective second end 182*b*, 183*b* is transverse to, e.g., perpendicular to, a length of shaft 162 (defined by rotational axis 161) of toner agitator 160. In the embodiment illustrated, supports 182, 183 are formed integrally with front 110 housing 102 and wall 194. That is, front 110 of housing 102, supports 182, 183 and wall 194 are formed from a unitary construction. For example, front 110 of housing 102, supports 182, 183 and wall 194 may be integrally formed by molding, e.g., injection molding, front 110 of housing 102, supports 182, 183 and wall 194 from a common plastic material, e.g., acrylonitrile butadiene styrene (ABS) plastic, along with top 106 and bottom 107 of housing 102. In some embodiments, the additional support provided to front 110 of housing 102 by supports 182, 183 permits walls of housing 102 to have a reduced material thickness (e.g., 1.5 mm instead of 2.0 mm) and still possess sufficient strength for operation. The reduced material thickness of the walls of housing 102 helps reduce the material cost of housing 102.

While the example embodiment illustrated includes a pair of supports 182, 183 positioned in close proximity to shaft 162 of toner agitator 160, more than two or fewer than two supports 182, 183 may be provided in close proximity to shaft 162 of toner agitator 160 to protect shaft 162 from excessive bending as desired. Further, while the example embodiment illustrated includes supports 182, 183 positioned in close proximity to shaft 162 of toner agitator 160, one or more supports may be positioned in close proximity to shaft 172 of toner agitator 170 as desired in order to protect shaft 172 of toner agitator 170 from excessive bending.

Figure 9:
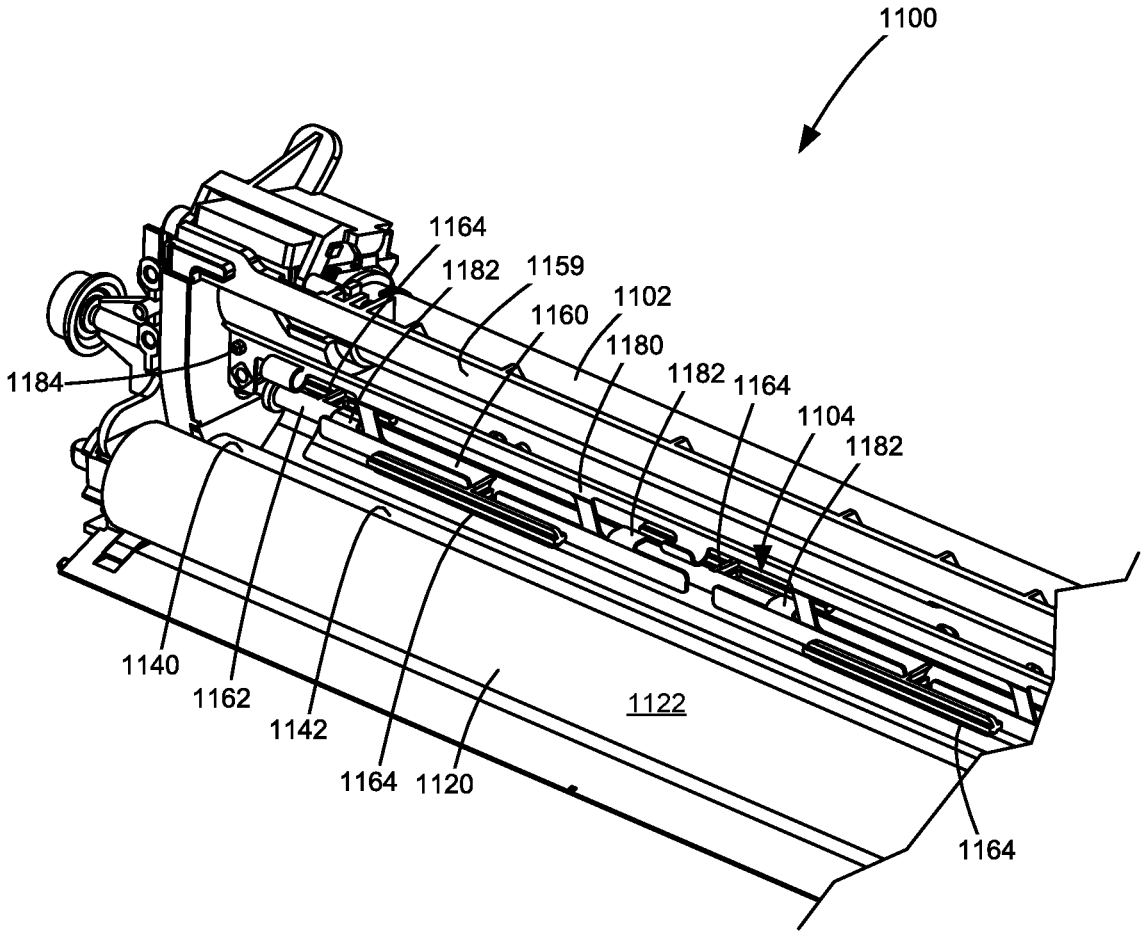
Figure 9 Prior Art
FIG. 9 is a perspective view of a prior art toner cartridge with a doctor blade of the toner cartridge and a corresponding bracket omitted to show internal components of the toner cartridge.

FIG. 9 shows a prior art toner cartridge 1100 that includes a housing 1102 having an enclosed reservoir 1104 for storing toner. A doctor blade of toner cartridge 1100 and a bracket that mounts the doctor blade to toner cartridge 100 are omitted from FIG. 9 in order to illustrate internal components of toner cartridge 1100. Toner cartridge 1100 includes a rotatable developer roll 1120 and a rotatable toner adder roll 1140 positioned to supply toner in reservoir 1104 to developer roll 1120. A portion of an outer surface 1142 of toner adder roll 1140 is in contact with a portion of an outer surface 1122 of developer roll 1120 along the lengths of toner adder roll 1140 and developer roll 1120. Toner cartridge 1100 includes a seal 1159 that is positioned between the doctor blade of toner cartridge 1100 and the portion of housing 1102 that the doctor blade of toner cartridge 1100 is positioned against. Toner cartridge 1100 also includes a rotatable toner agitator 1160 positioned near toner adder roll 1140. Toner agitator 1160 includes a rotatable shaft 1162 and a series of T-shaped projections 1164 extending radially outward from shaft 1162.

Toner cartridge 1100 also includes a metal plate 1180 positioned in reservoir 1104. Plate 1180 includes a series of rings 1182 that are positioned in close proximity to shaft 1162 of toner agitator 1160 and that encircle shaft 1162 of toner agitator 1160. Rings 1182 are spaced from shaft 1162 during normal operation of toner agitator 1160 so as not to interfere with the rotation of shaft 1162, but are positioned to contact shaft 1162 upon bending of shaft 1162 in order to limit the extent of bending of shaft 1162 to prevent breakage or dislocation of shaft 1162. Plate 1180, incidentally, also forms an electrode of a capacitive toner level sensing system of toner cartridge 1100 for detecting the toner level in reservoir 1104. Plate 1180 and a second electrode form a capacitor having a capacitance that varies in response to the amount of toner existing between plate 1180 and the second electrode. Sensing circuitry determines the capacitance of the capacitor formed by plate 1180 and the second electrode, which may be used to determine the amount of toner in reservoir 1104.

Each end of plate 1180 is attached to housing 1102 by a respective screw 1184 that passes through a corresponding opening in plate 1180 and into a corresponding screw boss formed in housing 1102. A portion of each end of plate 1180 is held against the respective screw boss of housing 1102 by an underside of a head of the corresponding screw 1184. However, unlike support(s) 180 of the present disclosure, plate 1180 of toner cartridge 1100 does not stiffen or increase the rigidity of housing 102 of toner cartridge 1100.

Although the example embodiment illustrated includes a toner agitator 160 and a support 180 positioned in a reservoir 104 of a toner cartridge 100 that supplies toner to image forming device 22 for printing, it will be appreciated that a toner agitator and corresponding support may be positioned in any toner reservoir, such as, for example, a reservoir for storing waste toner removed from the photoconductive drum of imaging unit 200. Further, it will be appreciated that the architecture and shape of toner cartridge 100 and imaging unit 200 illustrated is merely intended to serve as an example. Those skilled in the art understand that toner cartridges, imaging units, and other toner containers, may take many different shapes and configurations. Further, although the example embodiment illustrated includes a pair of replaceable units in the form of a toner cartridge and an imaging unit, it will be appreciated that the replaceable unit(s) of the image forming device may employ any suitable configuration as desired. For example, in one embodiment, the main toner supply for the image forming device, the developer unit, and the photoconductor unit are housed in one replaceable unit. In another embodiment, the main toner supply for the image forming device is provided in a first replaceable unit and the developer unit and photoconductor unit are provided in a second replaceable unit.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container for use in an electrophotographic image forming device, comprising:

a housing having a reservoir for storing toner;

a rotatable developer roll mounted on the housing for transferring toner from an outer surface of the developer roll to a corresponding photoconductive drum during operation of the toner container in the image forming device;

a doctor blade having a distal end in contact with the outer surface of the developer roll along a length of the developer roll for metering toner on the outer surface of the developer roll, the doctor blade has a proximate end positioned against a portion of the housing;

a toner agitator in the reservoir having a shaft; and a support in the reservoir positioned in close proximity to the shaft to limit bending of the shaft, a first end of the support contacts an inner surface of the portion of the housing that the proximate end of the doctor blade is positioned against, the support stiffening the portion of the housing that the proximate end of the doctor blade is positioned against.

2. The toner container of claim 1, further comprising a seal positioned between the proximate end of the doctor blade and the portion of the housing that the proximate end of the doctor blade is positioned against.

3. The toner container of claim 1, wherein the toner agitator is rotatable about a rotational axis defined by the shaft.

4. The toner container of claim 1, wherein the support is formed integrally with the portion of the housing that the proximate end of the doctor blade is positioned against.

5. The toner container of claim 1, further comprising a rotatable toner adder roll mounted on the housing and positioned to supply toner in the reservoir to the developer roll, wherein the toner agitator is positioned adjacent to the toner adder roll.

6. The toner container of claim 1, wherein the support at least partially encircles the shaft.

7. The toner container of claim 1, wherein the support is positioned in close proximity to the shaft at a point that is closer to a midpoint along a length of the shaft than to a first end of the shaft and a second end of the shaft.

8. The toner container of claim 1, wherein a longitudinal dimension of the support from the first end of the support to a second end of the support is transverse to a length of the shaft.

9. A toner container for use in an electrophotographic image forming device, comprising:

a housing having a reservoir for storing toner;

a rotatable developer roll mounted on the housing for transferring toner from an outer surface of the developer roll to a corresponding photoconductive drum during operation of the toner container in the image forming device;

a doctor blade having a distal end in contact with the outer surface of the developer roll along a length of the developer roll for metering toner on the outer surface of the developer roll, the doctor blade has a proximate end positioned against a portion of the housing;

a toner agitator in the reservoir having a shaft; and a support in the reservoir positioned in close proximity to the shaft to limit bending of the shaft, a first end of the support contacts an inner surface of the portion of the housing that the proximate end of the doctor blade is positioned against, the support is formed integrally with the portion of the housing that the proximate end of the doctor blade is positioned against.

10. The toner container of claim 9, further comprising a seal positioned between the proximate end of the doctor blade and the portion of the housing that the proximate end of the doctor blade is positioned against.

11. The toner container of claim 9, wherein the toner agitator is rotatable about a rotational axis defined by the shaft.

12. The toner container of claim 9, further comprising a rotatable toner adder roll mounted on the housing and positioned to supply toner in the reservoir to the developer roll, wherein the toner agitator is positioned adjacent to the toner adder roll.

13. The toner container of claim 9, wherein the support at least partially encircles the shaft.

14. The toner container of claim 9, wherein the support is positioned in close proximity to the shaft at a point that is closer to a midpoint along a length of the shaft than to a first end of the shaft and a second end of the shaft.

15. The toner container of claim 9, wherein a longitudinal dimension of the support from the first end of the support to a second end of the support is transverse to a length of the shaft.

16. A toner container for use in an electrophotographic image forming device, comprising:

a housing having a reservoir for storing toner;

a rotatable developer roll mounted on the housing for transferring toner from an outer surface of the developer roll to a corresponding photoconductive drum during operation of the toner container in the image forming device;

a rotatable toner adder roll mounted on the housing and positioned to supply toner in the reservoir to the developer roll;

a rotatable toner agitator in the reservoir having a shaft, the toner agitator is positioned to mix toner near the toner adder roll; and a support in the reservoir positioned in close proximity to the shaft to limit bending of the shaft, the support contacts an inner surface of the housing that defines a volume of the reservoir, the support is formed integrally with a portion of the housing, wherein the support is positioned in close proximity to the shaft at a point that is closer to a midpoint along a length of the shaft than to a first end of the shaft and a second end of the shaft.

17. The toner container of claim 16, wherein the toner agitator is positioned immediately above the toner adder roll.

18. The toner container of claim 16, wherein the support at least partially encircles the shaft.

19. The toner container of claim 16, wherein a longitudinal dimension of the support from a first end of the support to a second end of the support is transverse to a rotational axis of the shaft.

* * * * *